US005784822A

United States Patent [19]

Korapaty

[11] Patent Number: 5,784,822

[45] Date of Patent: Jul. 28, 1998

[54] RELIABLE SCOPE MOUNT

[76] Inventor: Bob V. Korapaty, 5243 Grace Ave., Brownsville, Tex. 78521

[21] Appl. No.: 834,453

[22] Filed: Apr. 15, 1997

[51] Int. Cl.[6] ..... F41G 1/387

[52] U.S. Cl. ..... 42/101; 33/247; 33/245

[58] Field of Search ..... 42/101, 103; 33/245, 33/246, 247, 248, 249, 250

[56] References Cited

U.S. PATENT DOCUMENTS

| | | | |
|---|---|---|---|
| 3,235,967 | 2/1966 | Mouve et al. | 33/247 |
| 3,986,285 | 10/1976 | Krisay | 33/248 |
| 4,026,055 | 5/1977 | Weast | 33/245 |
| 4,299,044 | 11/1981 | Johannsen | 42/101 |
| 4,446,644 | 5/1984 | Jimenez et al. | 42/101 |

FOREIGN PATENT DOCUMENTS

| | | | |
|---|---|---|---|
| 299177 | 12/1919 | Germany | 33/250 |
| 286537 | 2/1953 | Switzerland | 42/103 |

*Primary Examiner*—Stephen M. Johnson

*Attorney, Agent, or Firm*—Michael I. Kroll

[57] ABSTRACT

A scope mount (14) for retaining a scope (12) on one of a rifle and pistol (10). The scope mount (14) includes a clamping section (16) including first and second vice sections (24) and (26) forming a clamping mount (22) therebetween for clamping the scope mount (14) to one of the rifle and pistol (10). A scope mounting section (18) is provided for retaining a scope (18) thereon and a separator section (20) having a substantially U-shaped configuration including a first leg (62) connected to the first vice section (24) of the clamping section (16), a second leg (64) connected to the second vice section (26) and a spreader slot (28) between the first and second legs (62) and (64), connects the clamping section (16) to the scope mounting section (18). The scope mount (14) is operable in a first mounting mode in which a force is applied to the second vice section (26) in a direction away from the first vice section (24) causing the clamping mount (16) to expand to a size large enough to contain the rifle (10) therebetween and a second clamping mode in which a force is applied to both the first and second vice sections (24) and (26) causing the size of the clamping mount (16) to be reduced thereby clamping one of the rifle and pistol (10) therein.

5 Claims, 3 Drawing Sheets

RELIABLE SCOPE MOUNT

BACKGROUND OF THE INVENTION

1. Field of the Invention

The instant invention relates generally to rifles and pistols and, more specifically, to scope mounts for use with rifles and pistols.

2. Description of the Prior Art

Numerous scope mounts for rifles and pistols have been provided in the prior art. Such mounts have normally included numerous parts which act to complicate their use and are not reliable in their operation due to the interaction of the numerous parts. These prior art devices also do not provide for use with both long and standard eye relief scope types. Furthermore, prior art scope mounts for rifles and pistols are difficult to position and install on a rifle or pistol. While these units may be suitable for the particular purpose to which they address, they would not be as suitable for the purposes of the present invention as heretofore described.

In view of the problems associated with prior art scope mounts for rifles and pistols, a need exists for a scope mount which is easy to use, is adapted for use with both long and standard eye relief scope types and is readily installed and positioned on a rifle or pistol.

SUMMARY OF THE INVENTION

The present invention is concerned with rifles and pistols and, more specifically, to scope mounts for rifles and pistols.

A primary object of the present invention is to provide a scope mount for rifles and pistols that will overcome the shortcomings of the prior art devices.

Another object of the present invention is to provide a scope mount for rifles and pistols made of a single element A further object of the present invention is to provide a scope mount for rifles and pistols that is simple and easy to use.

A still further object of the present invention is to provide a scope mount for rifles and pistols that is economical in cost to manufacture.

A yet further object of the present invention is to provide a scope mount for rifles and pistols which is easily positioned and installed on the rifle or pistol.

A still further object of the present invention is to provide a scope mount for rifles and pistols that may be used with both long and standard relief scopes.

An additional object of the present invention is to provide a scope mount for rifles and pistols which remains stable during and after mount installation.

An even further object of the present invention is to provide a scope mount for rifles and pistols which may be used with top eject featured fire arms.

A scope mount for retaining a scope on one of a rifle and pistol is disclosed by the present invention. The scope mount includes a clamping section including first and second vice sections forming a clamping mount therebetween for clamping the scope mount to one of the rifle and pistol. A scope mounting section is provided for retaining a scope thereon and a separator section having a substantially U-shaped configuration including a first leg connected to the first vice section of the clamping section, a second leg connected to the second vice section and a spreader slot between the first and second legs, connects the clamping section to the scope mounting section.

The scope mount is operable in a first mounting mode in which a force is applied to the second vice section in a direction away from the first vice section causing the clamping mount to expand to a size large enough to contain the rifle therebetween and a second clamping mode in which a force is applied to both the first and second vice sections causing the size of the clamping mount to be reduced thereby clamping one of the rifle and pistol therein.

The foregoing and other objects, advantages and characterizing features will become apparent from the following description of certain illustrative embodiments of the invention.

The novel features which are considered characteristic for the invention are set forth in the appended claims. The invention itself, however, both as to its construction and its method of operation, together with additional objects and advantages thereof, will be best understood from the following description of the specific embodiments when read and understood in connection with the accompanying drawings. Attention is called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views.

LIST OF REFERENCE NUMBERS

Figures 1, 2:
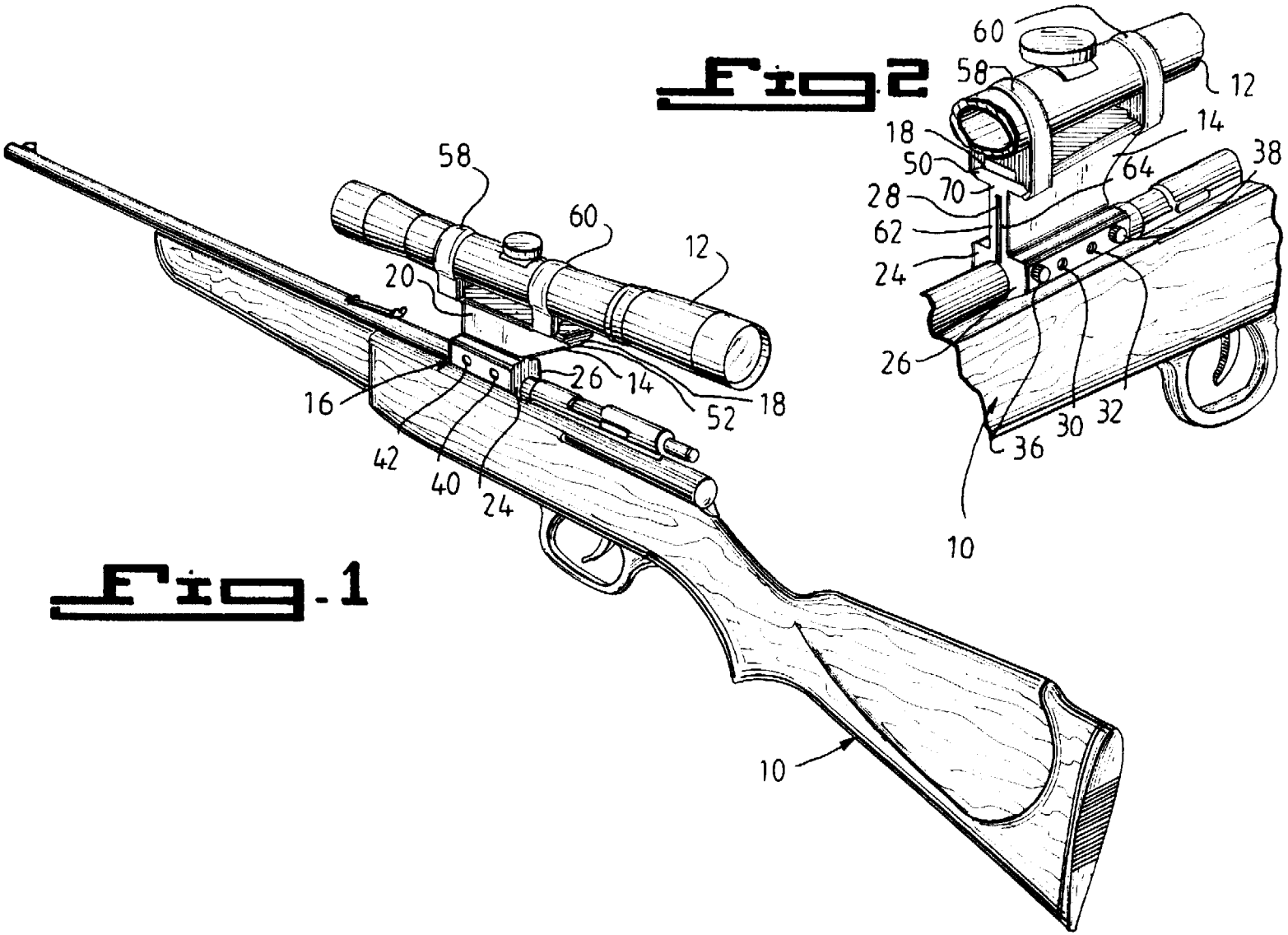
FIG. 1 is a perspective view of a rifle implementing the scope mount of the present invention.
FIG. 2 is an enlarged perspective view of the scope mount of the present invention with a scope mounted therein.
Figure 4:
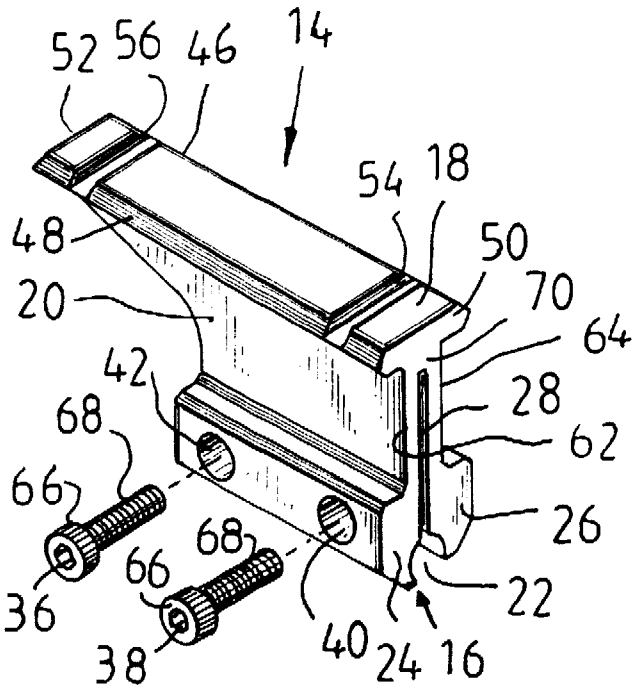
FIG. 4 is left side perspective view of the scope mount of the present invention.
Figure 3:
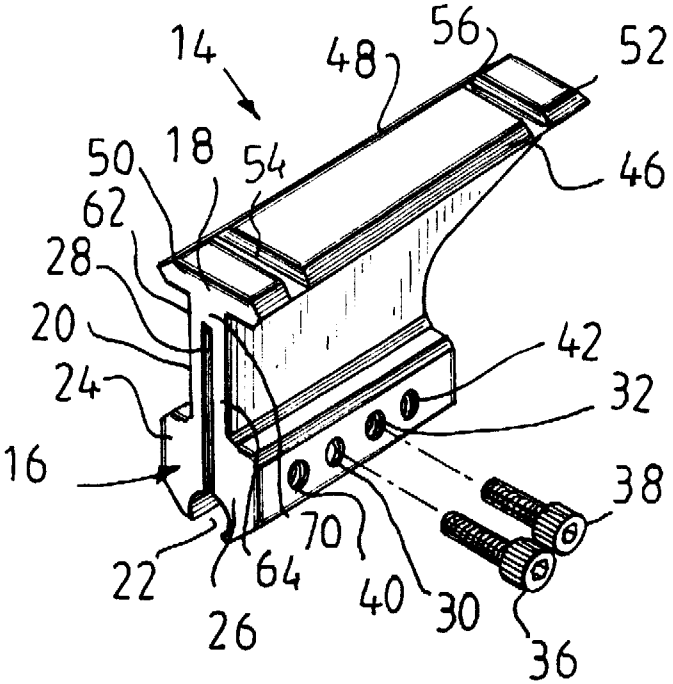
FIG. 3 is a right side perspective view of the scope mount of the present invention.
Figures 5, 6, 7, 8:
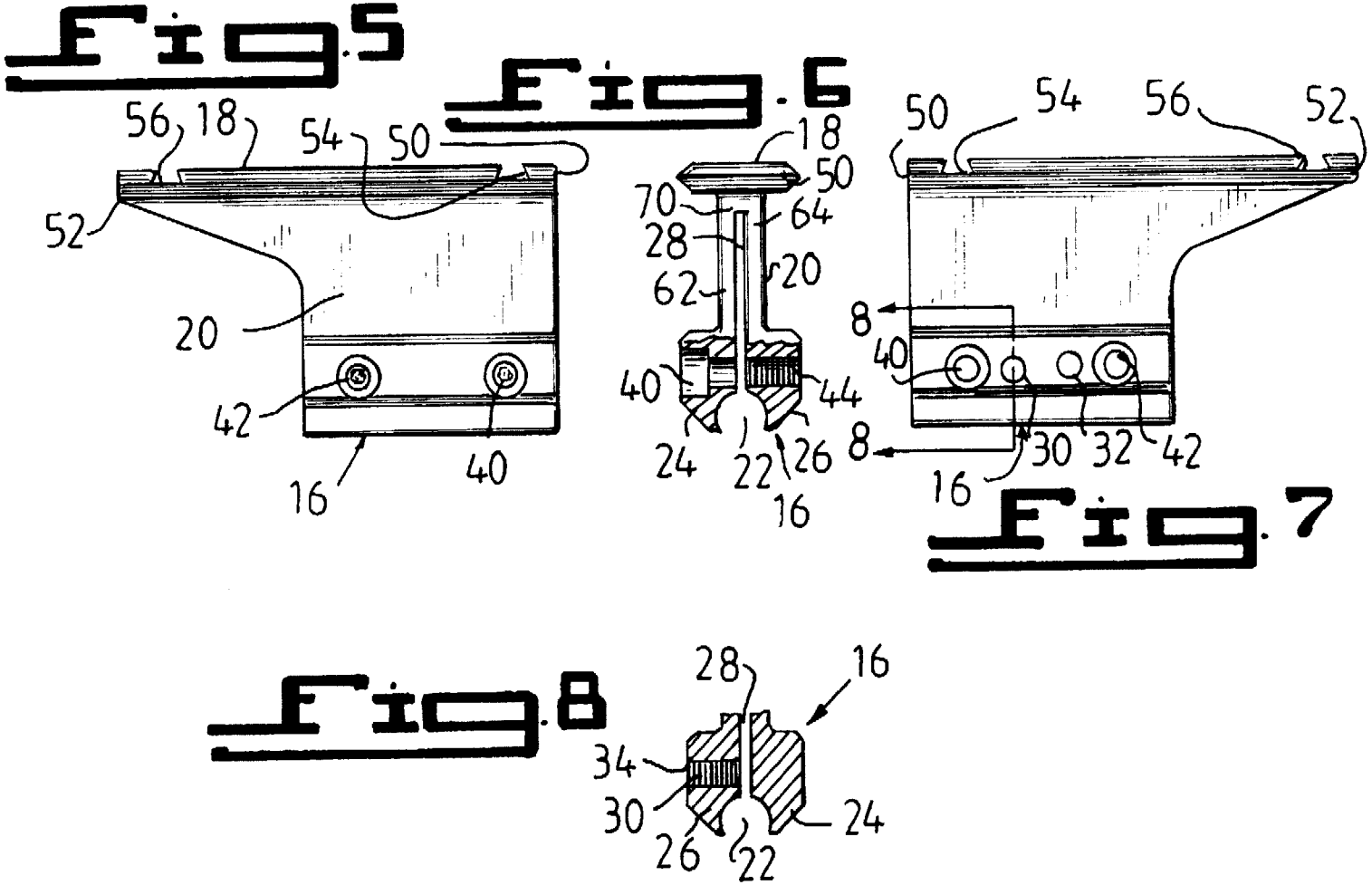
FIG. 5 is a left side view of the scope mount of the present invention.
FIG. 6 is a front view in partial cross-section of the scope mount of the present invention.
FIG. 7 is a right side view of the scope mount of the present invention.
FIG. 8 is a cross-sectional view of the clamping mount of the present invention taken along the line 8—8 of FIG. 7.

Turning now descriptively to the drawings, in which similar reference characters denote similar elements throughout the several views, the Figures illustrate scope mount for rifles and pistols of the present invention. With regard to the reference numerals used, the following numbering is used throughout the various drawing figures.

10 rifle
12 scope
14 scope mount
16 clamping section
18 scope mount section
20 mid section
22 clamping mount
24 first vice section
26 second vice section
28 spreader slot 30 first spreader hole
32 second spreader hole
34 thread within first and second spreader holes
36 first spreader screw
38 second spreader screw
40 first clamping hole
42 second clamping hole
44 thread within first and second clamping holes
46 first length side
48 second length side
50 front end of scope mount section
52 rear end of scope mount section
54 first dovetail ring slot
56 second dovetail ring slot
58 first dovetail ring
60 second dovetail ring
62 first leg
64 second leg
66 head section
68 threaded section
70 base section

DETAILED DESCRIPTION OF THE PREFERRED EMBODIMENTS

Turning now descriptively to the drawings, in which similar reference characters denote similar elements throughout the several views, the figures illustrate a scope mount for use with rifles and pistols. A rifle implementing the scope mount of the present invention is indicated generally by the numeral 10.

It is understood that reference to rifle herein is meant to include pistol.

The rifle 10 includes a scope 12 mounted thereon via the scope mount 14 of the present invention. The attachment of the scope mount 14 and scope 12 to the rifle 10 can be more clearly seen in FIG. 2. The scope mount includes a clamping section 16, a scope mount section 18 and a mid section 20 connecting the clamping section 16 and the scope mount section 18.

The clamping section 16 includes a clamping mount 22 defined by first and second vice sections 24 and 26 and extending along a length of the scope mount 14. More specifically, the clamping mount 22 is a recess positioned between the first and second vice sections 24, 26 formed by the shape and interaction of the first and second vice sections 24, 26 and shaped to retain the rifle or pistol 10 to which the scope mount 14 is to be mounted therein. The first and second vice sections 24, 26 are separated by a spreader slot 28. Positioned along the length of the second vice section 26 and extending therethrough to the spreader slot 28 are first and second spreader holes 30 and 32. The first and second spreader holes 30, 32 each include a thread 34 spiraling therearound. Each of the first and second vice sections 24 and 26 include a beveled relief area on a side opposite the spreader slot 28. The beveled relief areas allow the scope to be radially adjustable from a standard vertical position atop the rifle 10 and thereby extend at an angle to the rifle 10 when positioned thereon.

During a mounting mode in which the scope mount 14 is positioned on the rifle 10, first and second spreader screws 36 and 38, each including a head section 66 and a threaded section 68 including a thread spiraling therearound, may be inserted within the first and second spreader holes 30, 32. The first and second spreader screws 36, 38 engage the thread 34 within the first and second spreader holes 30, 32, respectively, whereby the spreader screws 36, 38 extend through their respective spreader holes 30, 32 and the spreader slot 28 to engage an inner side of the first vice section 24. As the spreader screws 36, 38 are turned to extend further into their respective spreader holes 32, 34 they exert a force against the first vice section 24 and act to increase the size of the spreader slot 28 for mounting the scope mount 14 on a rifle 10.

Positioned on either side of the first and second spreader holes 30, 32 are first and second clamping holes 40 and 42, each including a thread 44 spiraling therein. The first and second clamping holes 40, 42 extend through the vice section 26, spreader slot 28 and vice section 24. The first and second spreader screws 36, 38 are inserted into the first and second clamping holes 40, 42, respectively, and engage the thread 44 therein during a clamping mode in which the scope mount 14 is clamped to the rifle 10. As the first and second spreader screws 36, 38 are turned in a clockwise direction to extend further into their respective clamping holes they cross through the spreader slot 28 and engage the thread 44 within the respective clamping hole within the second vice section acting to force the first and second vice sections 24, 26 towards each other and reduce the size of the spreader section 28 to clamp the scope mount 14 to the rifle 10 after mounting.

The scope mount section 18 has a length greater than that of the rifle mount section 16 and has first and second length sides 46, 48. Each of the first and second length sides 46, 48 have a dovetail shape for accommodating the scope 12 thereon. First and second dovetail ring slots 54 and 56 are positioned at a front and rear end 50, 52 of the scope mount section 18, respectively. The first and second dovetail ring slots 54 and 56 extend perpendicular to the first and second length sides 46, 48 and across the width of the scope mount section 18. In order to mount and secure the scope 12 to the scope mount 14, first and second dovetail rings 58, 60 are positioned within the first and second dovetail ring slots 54, 56 securing the scope 12 therein.

The mid section 20 extends between and connects the rifle mount section 16 and the scope mount section 18. The mid section 20 is substantially U-shaped whereby the spreader slot 28 extends therethrough to form first and second legs 62, 64. The first leg 62 is connected to the first vice section 24 and the second leg 64 is connected to the second vice section 26. The scope mount section 18 is connected to a base 70 of the U-shaped mid section 20.

In operation, the first and second spreader screws 36, 38 are inserted into the first and second spreader holes 30, 32 respectively extending through the second vice section 26 wherein they each engage a thread 34. The first and second spreader screws 36, 38 are rotated in a clockwise direction to extend further into their respective spreader hole 30, 32 until they contact the first vice section 24. Clockwise rotation of the first and second spreader screws 36, 38 continues whereby a force is exerted on the first vice section 24 causing it to be pushed away from the second vice section 26 and causing the first and second legs 62, 64 of the mid section 20 to be forced apart thus enlarging the spreader slot 28. Upon expanding the spreader slot 28 to an appropriate size, the clamping mount 22 is positioned atop the rifle 10 and the first and second spreader screws 36, 38 are removed. Removal of the spreader screws 36, 38 removes the force against the first vice section allowing it to return to its original position whereby it engages the rifle 10 and clamps the rifle 10 between the first and second vice sections 24, 26 of the scope mount 14. The scope mount 14 may now be rotated from its standard vertical position about the connection with the rifle 10 until the desired angle for the scope 12 is achieved. Thus, the scope mount 14 may extend at an angle from the rifle 10.

The spreader screws are now inserted into the first and second clamping holes 40, 42. The first and second spreader screws 36, 38 are rotated in a clockwise direction to extend further into their respective clamping hole 40, 42 whereby they are caused to engage the thread 44 therein and extend through the first vice section 24, spreader slot 28 and second vice section 26 to securely clamp the scope mount 14 to the rifle 10.

The scope 12 can now be clamped to the scope mount 14 and thus to the rifle 10. The scope 12 is positioned atop the scope mount section 18 whereby the edges of the scope 12 engage the dovetails carved along the first and second length sides 46, 48. The scope 12 is also positioned to engage the first and second dovetail ring slots 54, 56 atop the scope mount section 18. The first and second dovetail rings 58, 60 are now clamped about the scope 12 and in engagement with the first and second dovetail ring slots 54, 56 to secure the scope 12 to the rifle 10.

The scope mount 14 is easily removed from the rifle 10 by turning the first and second spreader screws 36, 38 in a counterclockwise direction. This will act to disengage the first and second spreader screws 36, 38 from its engagement with the thread 44 and release the first and second spreader screws 36, 38 from the first and second clamping holes 40, 42. The first and second legs 62, 64 of the mid section 20 may then be separated by exerting a force on each leg directed away from the point of engagement with the rifle 10 and the scope mount 14 may be lifted off the rifle 10. The first and second legs 62, 64 may also be spread by inserting the spreader screws 36, 38 into the spreader holes and turning the spreader screws 36, 38 in a clockwise direction. This acts to separate the first and second legs 62, 64, as previously described, for removal of the scope mount 14 at this time.

It is to be understood that the scope mount for retaining a scope on one of a rifle and pistol in accordance with the present invention can be made from a single piece of material and may be formed of any suitable material such as steel, iron, any alloy thereof, any alloy of a light weight casted metal or molded material, wood, plastic, or any combination of materials and the like and that the invention is not intended to be limited by the materials from which the scope mount is formed.

The present invention is thus able to provide a scope mount 14 for rifles and pistols 10 that will overcome the shortcomings of the prior art devices, is simple and easy to use and is also economical in cost to manufacture by producing the scope mount 14 from a single element and thereby eliminating unnecessary parts. The scope mount 14 of the present invention is easily positioned and installed on the rifle or pistol 10 and may be used with both long and standard relief scopes 12. Furthermore, the scope mount 14 of the present invention remains stable during and after mount installation and may be used with top eject featured fire arms.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A scope mount for retaining a scope on a rifle comprising:

a) a mount section for retaining said scope;

b) means for clamping said scope mount to said rifle;

c) said clamping means comprising a mid section connected at one end to said mount section and having first and second legs extending away from said mount section, said legs being spaced to form a spreader slot, and each of said legs terminating in ends shaped to engage said rifle;

d) said first and second legs having a pair of recesses, the recesses in one of said legs being threaded, adjacent said shaped ends accommodating threaded screw members for clamping said legs on said rifle;

e) said second leg having another threaded recess adjacent the shaped end thereof engaging said rifle accommodating a threaded screw member to engage said first leg to spread said legs for enlarging said spreader slot to permit said scope mount to be placed on or removed from said rifle; and f) means to allow said scope mount to be radially adjustable from a standard vertical position atop said rifle.

2. A scope mount for retaining a scope on said rifle as recited in claim 1, wherein said scope mount section includes first and second length sides, each having a dovetail formed thereon for mating with the scope.

3. A scope mount for retaining a scope on said rifle as recited in claim 1, wherein said scope mount section further includes a width and first and second dovetail ring slots extending parallel to said width and said scope further includes first and second dovetail rings, wherein the dovetail rings are positioned to engage said dovetail ring slots when the scope is mounted to said scope mount section.

4. A scope mount for retaining a scope on said rifle as recited in claim 1, wherein said mount section, mid section and legs are all formed from a single piece of material.

5. The method of mounting a scope mount comprising a mount section and clamping means on a rifle comprising the steps of:

a) attaching said scope to said mount section;

b) clamping said scope mount to said rifle using a mid section connected at one end to said mount section and having first and second legs extending away from said mount section, said legs being spaced to form a spreader slot, and each of said legs terminating in ends shaped to and engaging said rifle;

c) threading screw members through recesses in one of said legs and through threaded recesses in the other of said legs adjacent said shaped ends for clamping said legs on said rifle; and d) threading a screw member through another threaded recess in one of said legs adjacent the shaped end thereof to engage the other said leg to spread said legs for enlarging said spreader slot to permit said scope mount to be placed on or removed from said rifle.

* * * * *